US006786117B1

(12) United States Patent
Tseng

(10) Patent No.: US 6,786,117 B1
(45) **Date of Patent: *Sep. 7, 2004**

(54) VERSATILE USE PLIERS

(75) Inventor: Yi Chuan Tseng, Taichung Hsien (TW)

(73) Assignee: AWI Acquisition Company, Sylmar, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/339,964

(22) Filed: Jan. 10, 2003

(51) Int. Cl.[7] ..... B24B 7/02
(52) U.S. Cl. ..... 81/303; 81/311
(58) Field of Search ..... 81/303, 304, 305, 81/306, 307, 311, 421; 7/125, 127, 129

(56) References Cited

U.S. PATENT DOCUMENTS 816,674 A * 4/1906 Medhus ..... 81/305
1,079,997 A * 12/1913 Wernimont ..... 81/305
2,446,022 A * 7/1948 Peterson ..... 81/305
4,316,315 A * 2/1982 Vogelnik ..... 81/305
5,245,721 A * 9/1993 Lowe et al. ..... 7/129
6,023,805 A * 2/2000 Lin ..... 7/125
6,223,374 B1 * 5/2001 Lin ..... 7/127
6,257,105 B1 * 7/2001 Lin ..... 81/302
6,389,626 B1 * 5/2002 Hung ..... 81/305

* cited by examiner

*Primary Examiner*—Hadi Shakeri
(74) *Attorney, Agent, or Firm*—Jack C. Munro

(57) ABSTRACT

A versatile use pliers which has a first pair of jaws reversely positioned relative to a second pair of jaws. Both pairs of jaws are to be simultaneously movable between an open and a closed position. Movement of the jaws between the open and closed position is accomplished by a handle assembly upon which both sets of jaws are mounted. The handles are pivotable about one-hundred and forty degrees which will remove one set of jaws from an operating position and substitute the other set of jaws in the operating position. The pair of jaws are connected together about a connecting axis arrangement which is separate from and spaced from the pivot axis arrangement for each pair of jaws.

3 Claims, 6 Drawing Sheets

VERSATILE USE PLIERS

BACKGROUND OF THE INVENTION

1. Field of the Invention

This invention relates generally to tools and more particularly to a pliers type of tool which embodies a pair of different jaws within the same tool.

2. Description of the Related Art

Hand tools, of different types, have long been known. A common form of hand tool is known a pliers. A typical pliers has a head which is defined by a pair of jaws which can be manipulated by a pair of handles into a pincher-like action on an exterior structure. There are different types of plier heads. There is what is deemed as sharp nose or needle nose type of pliers head. There is also as what is referred to as a snub nose type of pliers head. Tradesmen and homeowners frequently carry both types of pliers on their person or within their toolbox. If both heads could somehow be incorporated within a single tool, then the tradesman or homeowner could only be required to carry a single tool rather than two different tools. It has been known to form a combination type tool in the form of a pliers wherein two different types of heads of pliers are incorporated within a single tool. Reference is to be had to U.S. Pat. No. 5,245,721, which shows such a combination tool. However, the combination tool of the prior art has certain deficiencies. One of the deficiencies is that there is basically a one-to-one application of force relative to the squeezing force applied to the handle. In other words, if a ten pound squeezing force is applied to the handles, then there is a ten pound gripping force applied to the exterior structure by the jaws of the head of the tool. The reason for this is that most pliers of the prior art are constructed so that the connecting axes of the handles to the jaws are aligned with the pivot axes for the different pairs of jaws. If the connecting axes were not the same as the pivot axes then greater leverage could be obtained, such as for example, applying only five pounds of force to the handles in order to produce a ten pound gripping force onto the exterior structure. At times, this greater application of force is desirable such as when a tradesman or a homeowner is attempting to collapse a portion of a tube or in any situation where a greater amount of force is needed.

Additionally, in a pair of pliers which has two different pairs of jaws which are reversely positioned to each other, it is most common to have both pairs of jaws being mounted together in a scissors arrangement. Therefore, when the pair of pliers is moved from an open position to a closed position, both sets of jaws will simultaneously move from the open to the closed position. However, in some situations, it is desirable to have one of the sets of jaws move oppositely to the other set of jaws. This means that when the squeezing force is applied to the handles of the pliers that one of the sets of jaws actually move from a closed position to the open position. This type of pliers could be used to install snap rings, apply an outward force to the interior wall of a tube or pipe, facilitate the installation of o-rings and other similar types of tasks.

SUMMARY OF THE INVENTION

The first embodiment of versatile use pliers of the present invention is defined as having a first pair of jaws and a second pair of jaws. The second pair of jaws is reversely positioned to the first pair of jaws. The first pair of jaws has a first pivot axis about which the first pair of jaws is movable between a first closed position and a first open position, the second pair of jaws has a second pivot axis about which a second pair of jaws is movable between a second closed position and a second open position. The second pair of jaws is pivotally mounted to the first pair of jaws by means of a pair of spaced apart connecting axes each of which is spaced from the first pivot axis and the second pivot axis. A handle assembly is pivotally mounted to both the first pair of jaws and the second pair of jaws.

A further embodiment of the present invention is where the first basic embodiment is modified by the handle assembly including abutments that press against the jaws to produce movement between the open position and the closed position.

A further embodiment of the present invention is where the first basic embodiment is modified by the handle assembly being pivotally mounted on the connecting axes.

A further embodiment of the present invention is where the first basic embodiment is modified by the connecting axes being located between the first pivot axis and the second pivot axis.

A further embodiment of the present invention is where each connecting axis is located between one-quarter to one-half an inch from an abutment that is used to press the jaws to produce the movement between the open position to the closed position.

A further embodiment of the present invention is where the first basic embodiment is modified by the first jaw members and the second jaw members each being connected together in a scissors arrangement which will cause both pairs of jaws to open and close together.

A further embodiment of the present invention is where the first basic embodiment is modified by the first jaw members being connected in a scissors arrangement while the second jaw members are connected together in a side-by-side arrangement. During movement of the first jaw members toward an open position will result in the second jaw members being moved toward a closed position.

A second embodiment of versatile use pliers is where there is a first pair of jaws pivotally mounted by a connecting axis arrangement to a second pair of jaws. The first pair of jaws has a first pair of first jaw members which are pivotally mounted together at a first pivot axis and the second pair of jaws have a second pair of jaw members pivotally mounted at a second pivot axis. The second pivot axis is spaced from the first pivot axis with both the first pivot axis and the second pivot axis being spaced from the connecting axis arrangement. A handle assembly is pivotally mounted to both pairs of jaws. The handle assembly is to be manually operated to cause both pairs of jaws to simultaneously move between an open position and a closed position.

A further embodiment of the present invention is where the second basic embodiment is modified by the connecting axis arrangement comprising two spaced apart axes.

A further embodiment of the present invention is where the just previous embodiment is modified by the first connecting axis and the second connecting axis being located the same distance from the first pivot axis.

A further embodiment of the present invention is where the just previous embodiment is modified by the first connecting axis and second connecting axis being located the same distance from the second pivot axis.

A further embodiment of the present invention is where the second basic embodiment is modified by the first pair of jaws being located in a reverse position relative to the second pair of jaws.

A further embodiment of the present invention is where the second basic embodiment is modified by the connecting axis arrangement being located between the first pivot axis and the second pivot axis.

A further embodiment of the present invention is where the second basic embodiment is modified by the handle assembly being pivotally mounted to both pairs of jaws at the connecting axes.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
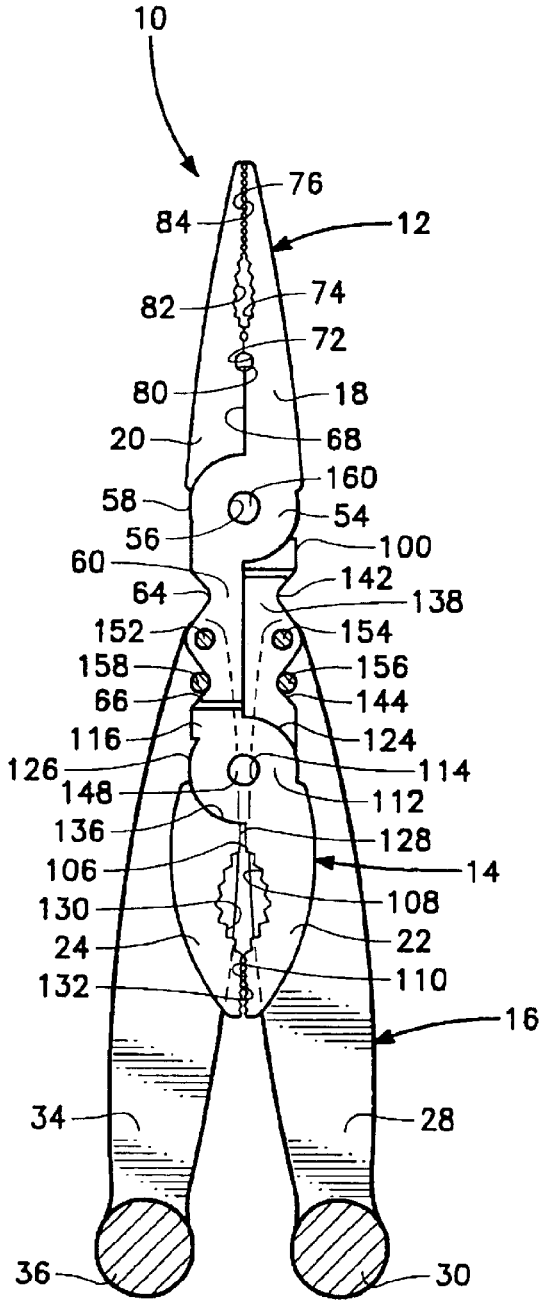
FIG. 1 is a side elevational view of the first embodiment of pliers of this invention showing both jaws of the pliers located in the closed position.
Figure 2:
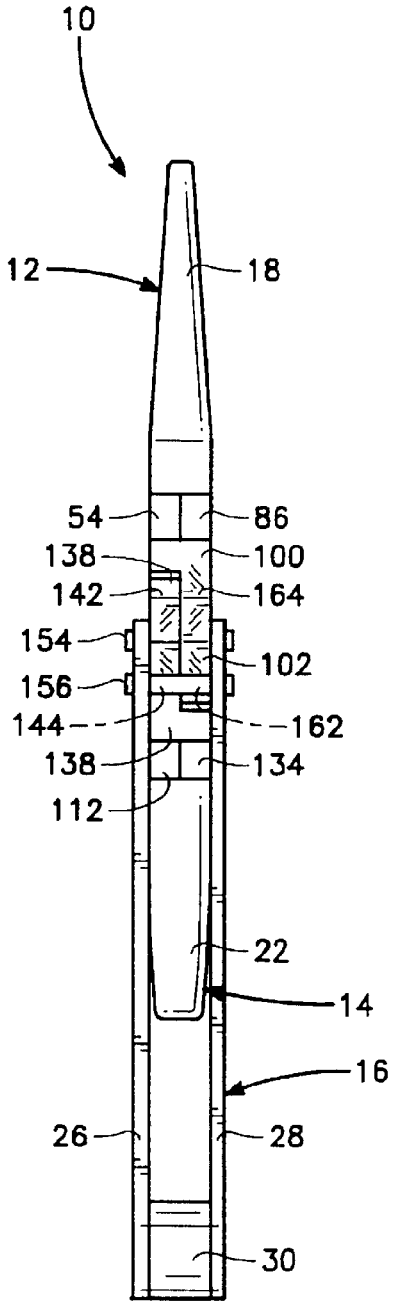
FIG. 2 is a right side elevational view of the pliers of FIG. 1 with the left side elevational view being substantially identical.

Referring particularly to FIGS. 1–4 of the drawings, there is shown the first embodiment 10 of pliers of this invention. The first embodiment 10 is composed primarily of a first pair of jaws 12, a second pair of jaws 14 and a handle assembly 16. The first pair of jaws 12 is formed of a first pair of jaw members composed of jaw member 18 and jaw member 20. The second pair of jaws 14 is constructed of a second pair of jaw members composed of jaw members 22 and 24. Handle assembly 16 is composed of handle members 26 and 28 which are composed of thin identically sized plates which are located parallel to each other but spaced apart. The handle members 26 and 28 have mounted therebetween at their outer free end thereof a spacer plug 30. The handle members 26 and 28 are fixedly mounted to the spacer plug 30. In a similar manner, the handle assembly 16 also includes a handle member 32 and a handle member 34 which again are identical to each other and are connected together at their outer free end thereof by a spacer plug 36 which are fixed between the handle members 32 and 34. At the end of the handle member 26 that is opposite the free outer end, there is formed through the handle member 26 a hole 38 and a hole 40. Similarly, at the opposite end of the handle member 28, which is opposite the free outer end, there is located a hole 42 and a hole 44. At the end of the handle member 32, which is opposite the free outer end, there is located a hole 46 and a hole 48. At the end of the handle member 34, which is opposite the free outer end, there is located a hole 50 and a hole 52. Hole 38 is to be in alignment with hole 42. Hole 40 is to be in alignment with hole 44. Hole 46 is to be in alignment with hole 50 and hole 48 is to be in alignment with hole 52. The handle members 26 and 28 form a single handle. Handle members 32 and 34 also form a single handle.

Jaw member 18 has a center section 54 which has a through hole 56. The center section 54 also includes a cam surface 58 which constitutes a segment of a circle with the center of the circle coinciding with the center of the through hole 56. Integrally connected to the center section 54 is a rear extension 60. Rear extension 60 has a through hole 62 and recesses 64 and 66. The cam surface 58 is formed between jaw face 68 and plate 70. The jaw face 68 is to include part of a wire stripper 72, a serrated recess 74 and a serrated gripping planar surface 76.

The jaw member 20 includes a jaw face 78 which also includes a part of a wire stripper 80, a serrated recess 82 and a serrated gripping planar surface 84. The planar surfaces 76 and 84 are to work together to function to grip an exterior object. The serrated recesses 74 and 82 also function to work together to grip onto a rounded exterior object, such as a tube. The wire strippers 72 and 80 also function to work together to strip a covering from an electrical wire.

Figure 3:
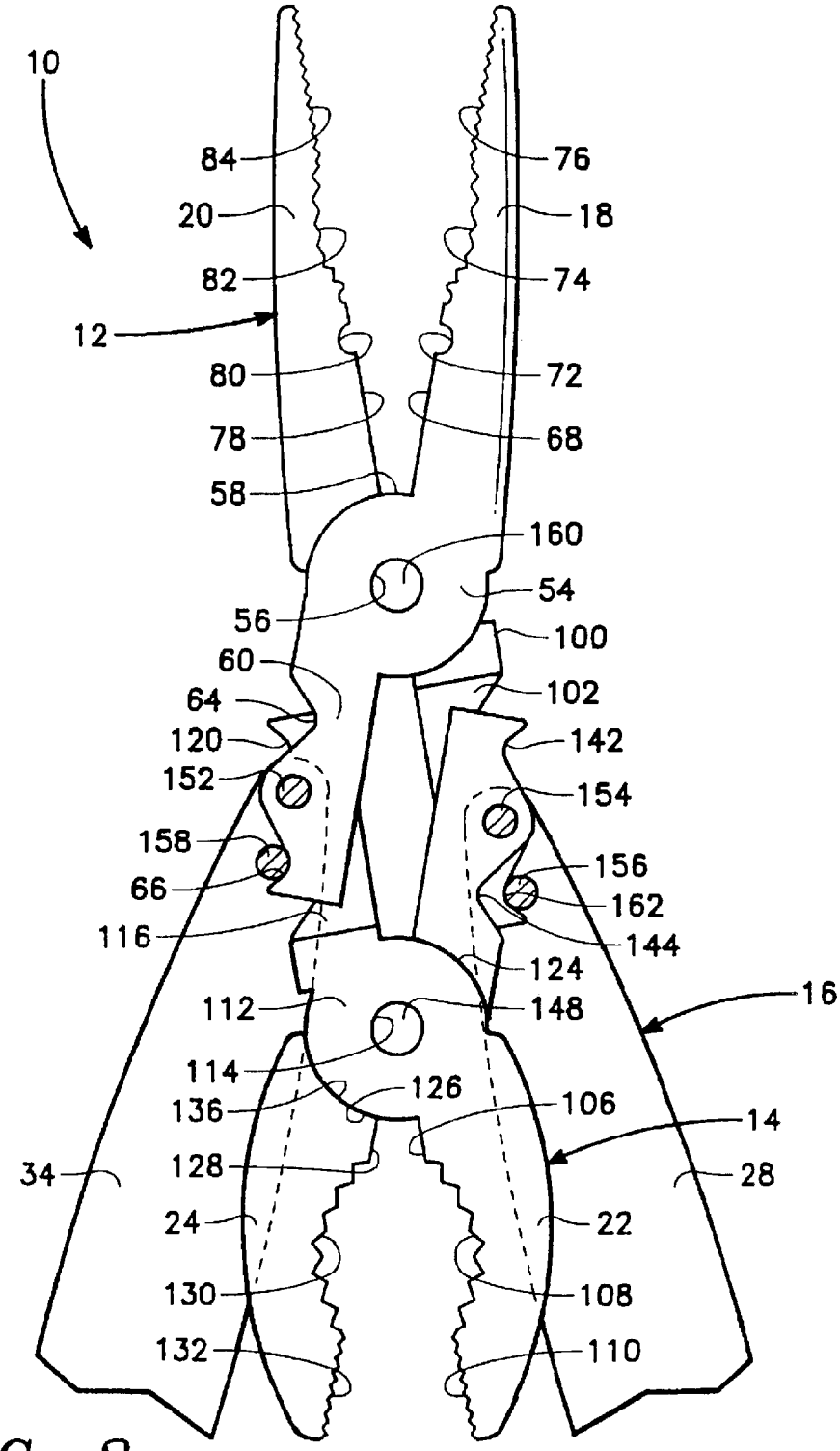
FIG. 3 is an enlarged view of the jaws of the pliers of FIG. 1 showing the jaws in the open position.
Figure 4:
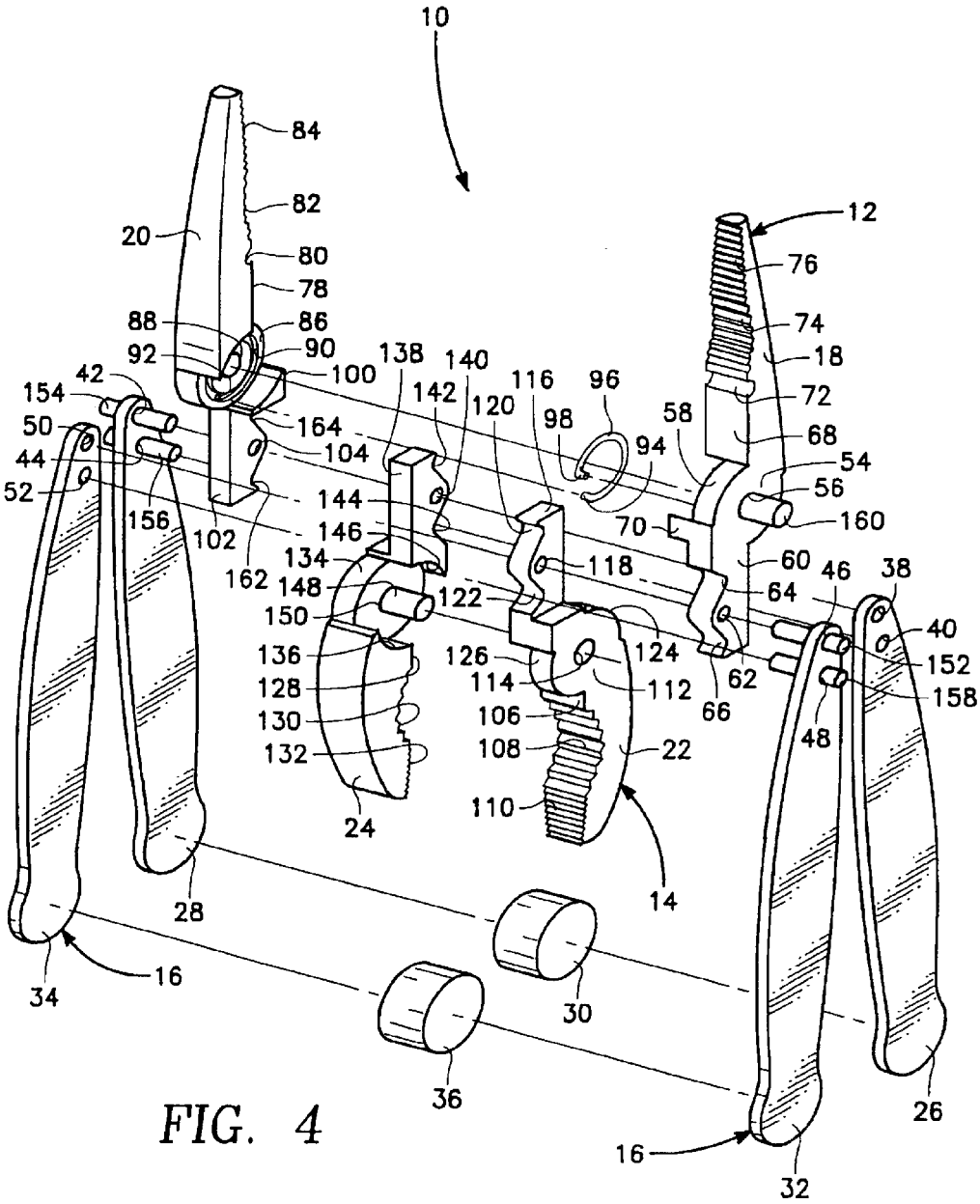
FIG. 4 is an exploded isometric view of the first embodiment of pliers of this invention.

The jaw member 20 is integral with a center section 86 which includes a through hole 88. The center section 86 has an inner face within which is formed an annular groove 90. Connecting with the annular groove 90 is a hole 92. The hole 92 is to connect with an end 94 of a wire spring 96. The end of the spring that is opposite the tine 94 terminates in an end 98. This end 98 is to be mounted within a hole, which is not shown, formed within a flat planar inner surface of the center section 54. It will be the function of the spring 96 to exert a continuous bias to the first pair of jaws 12 that will tend to locate the first pair of jaws 12 and the second pair of jaws 14 in the open position, which is shown in FIG. 3 of the drawings. Integral with the center section 86 is a cradle 100. Also integral with the center section 86 is a rear extension 102. Rear extension 102 has a through hole 104.

Jaw member 22 has a jaw face 106 which is basically planar with the exception of a serrated gripping recess 108. The jaw face 106 also includes a planar serrated gripping surface 110. The jaw member 22 includes a center section 112 which includes a through hole 114. Integrally connected to the center section 112 is a rear extension 116. Formed within the rear extension 116 is a through hole 118. Also formed within the extension 116 are recesses 120 and 122. The exterior surface of the center section 112 includes cam surfaces 124 and 126 each of which are segments of a cylinder which has a center axis which coincides with the longitudinal center axis of hole 114.

The jaw member 24 also includes a jaw face 128 within which is formed a serrated recess 130 and a planar serrated surface 132. The jaw member 24 is integrally connected to a center section 134. The jaw member 24 has a cradle surface 136 located directly adjacent the center section 134. Integrally connected to the center section 134 is a rear extension 138. This rear extension 138 has a through hole 140 and a pair of recesses 142 and 144 formed on its inner surface thereof. The portion of the rear extension 138 that is located directly adjacent the center section 134 includes a cradle surface 146. Cradle surfaces 136 and 146 are part of a cylinder which has a center axis which coincides with the longitudinal center axis of hole 150.

A pivot pin 148 is to be mounted within through hole 114 and through hole 150 of center section 134. This mounting is such that the cam surface 124 will rest against the cradle surface 146 and cam surface 126 will rest against the cradle surface 136. This will place the jaw faces 106 and 128 in juxtaposition. The jaw member 22 will be pivotally movable relative to jaw member 24 between the closed position shown in FIG. 1 to the open position shown in FIG. 3. The open position in FIG. 3 can be expanded with jaw members 18 and 20 located at a greater angular relationship.

A pivot pin 152 is to connect between hole 46, through hole 62, through hole 118 and hole 44. Pivot pin 154 connects with hole 38, through hole 140, through hole 104 and hole 42. Connecting pin 156 connects between hole 40 and hole 44. Connecting pin 158 connects between hole 48 and hole 52. Pivot pins 152 and 154 and connecting pins 156 and 158 are generally located between the pivot pins 148 and 160.

When the first embodiment 10 is assembled together, the first pair of jaws 12 are movable between an open position, shown in FIG. 3, to a closed position, shown in FIG. 1, and during this movement the second pair of jaws 14 is also movable from an open position, shown in FIG. 3 to the closed position, shown in FIG. 1. During this movement, pivoting occurs about the pivot pins 152 and 154 (connecting axes) as well as about the pivot pin 160 (first pivot axis) that connects between the holes 56 and 88 and also about pivot pin 148 (second pivot axis) that connects between the holes 114 and 150. Also, center section 54 will slide on cradle 100 and center section 112 will slide on cradle surface 136. When the first pair of jaws 12 are in the normal operating position, which is shown in FIG. 1, the connecting pin 156 or first abutment rides within the recess 162 formed within rear extension 102. Rear extension 102 also includes a recess 164. Connecting pin 158 or second abutment rides within recess 66 and connecting pin 156 rides within recess 162. When the handle assembly 16 is squeezed, the connecting pins 156 and 158, by applying pressure against the recesses 162 and 66 and extensions 102 and 60 causes jaw member 20 to pivot clockwise about pivot pin 160 and jaw member 22 to pivot clockwise about pivot pin 148. This squeezing action will cause jaw member 18 to pivot counterclockwise about the pin 160 and jaw member 24 to also pivot counterclockwise. The result is that the first pair of jaws 12 are intended to be used to apply pressure against an exterior object, which is not shown.

The handle assembly 16 can be flipped approximately one hundred and forty degrees which will cause connecting pin 158 to be moved in connection with recess 64 and connecting pin 156 to move in conjunction with recess 142. This will result in the second pair of jaws 14 to be placed in the operative position and the first pair of jaws 12 placed within the confines of the handle assembly 16, which is deemed to be the storage position. Although it is to be understood that it is possible that the first pair of jaws 12, when in the storage position, could be used. The same is also true for the second pair of jaws 14 when in the storage position, as is shown in FIGS. 1 and 3 of the drawings. Utilizing of the first embodiment 10, it can thus be seen that the user has the option of selecting either the first pair of jaws 12 or the second pair of jaws 14 to be utilized, which therefore incorporates two different types of pliers within one particular unit.

The fact that the abutments, which comprises the connecting pins 156 and 158, apply pressure against the jaws 12 and 14 at some distance spaced from the pivot pins 110 and 148 that there is a substantially increased leverage that is obtained in conjunction with the first embodiment 10 of pliers of this invention. The pivoting of the handle assembly 16 is accomplished solely about the pins 152 and 154.

Referring particularly to FIGS. 5–9 of the drawings, there is shown the second embodiment 166 of this invention. The second embodiment 166 is basically similar to the first embodiment 10 and like numerals are being employed to refer to like parts. There is a third set of jaws 168 and a fourth set of jaws 170. The primary distinction of the second embodiment 166 from the first embodiment 10 is that the in the first embodiment 10 jaw members 18 and 20 were connected together in a scissors type arrangement, and also jaw members 22 and 24 were connected together in a scissors type arrangement. However, in the second embodiment 166 of pliers, the jaw members 172 and 174 are not mounted in a scissors arrangement but are mounted in a side-by-side arrangement. Jaw member 172 is integrally connected to a center section 176 within which is mounted a through hole 178. Integrally connected with the center section 176 is a rear extension 180. The extension 180 is in direct alignment with the jaw member 172 located on the opposite side of the center section 176 and displaced laterally on the same side relative to hole 178, where within the first embodiment 10 of this invention, the equivalent structure rear extension 60 was located laterally displaced on an opposite side of hole 56 (an X configuration). The same is true for the jaw member 174 which is integral with the center section 184 which includes a through hole 186. The center section 184 is integral with a rear extension 188 which includes a through hole 190. The rear extension 188 is in alignment with the portion of the jaw member 174 that is located on the opposite side of the center section 184. The center section 176 includes a cylindrical cam surface 192 which is to rest and connect with cylindrical cam surfaces 194 and 196 of the jaw member 174. A pivot pin 198 is mounted between the through holes 178 and 186.

It is to be noted that the fourth set of jaws 170 are precisely the same as the second pair of jaws 14 and are mounted in a scissors type arrangement, with, again, like numerals being employed to like parts. This scissors arrangement was previously described in relation to the first embodiment 10 of this invention.

Figure 5:
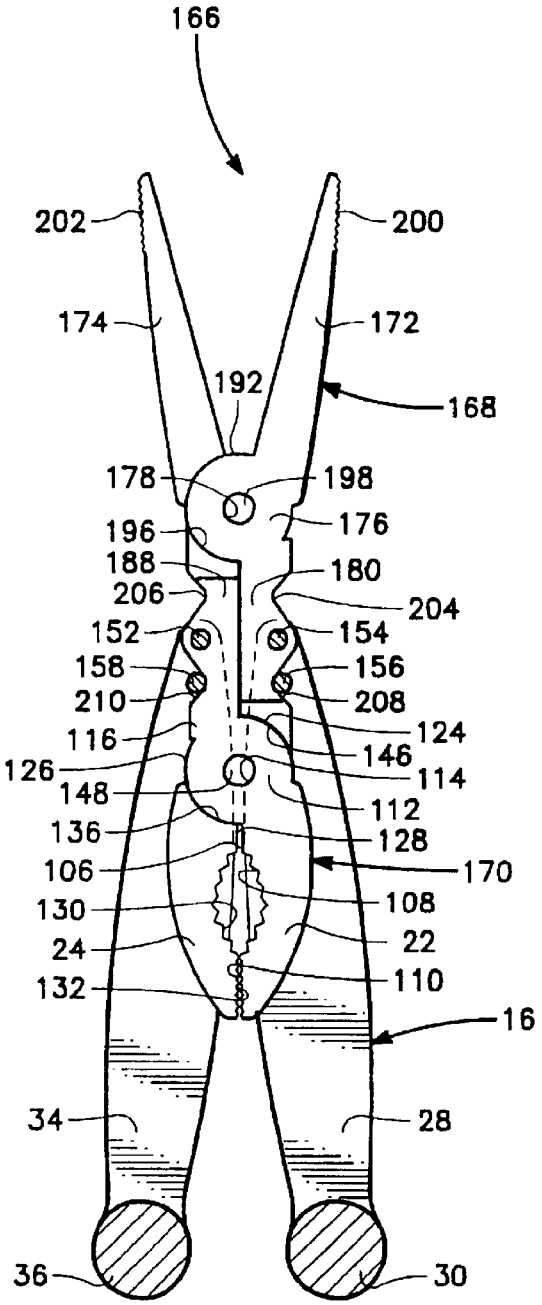
FIG. 5 is a top plan view of a second embodiment of pliers of the present invention where one pair of the jaws moves in an opposite direction to the opposite pair of jaws.
Figure 6:
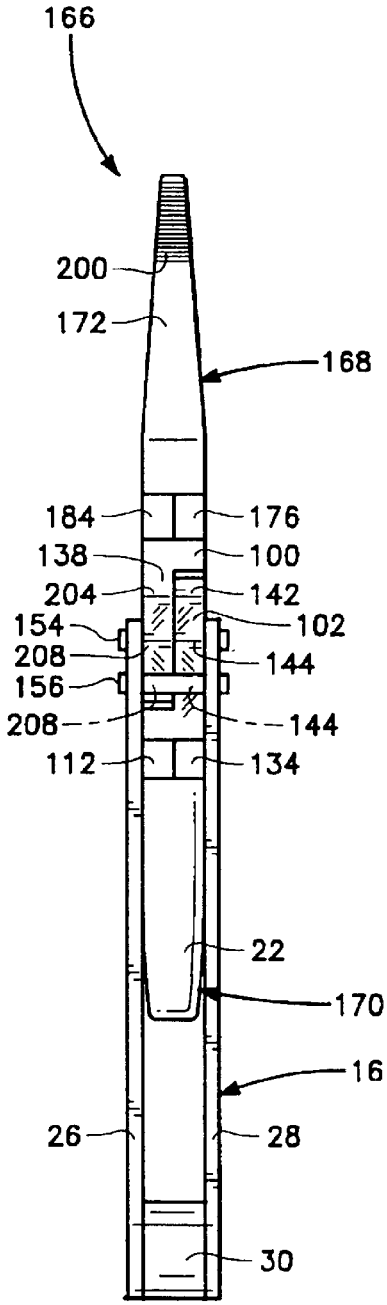
FIG. 6 is a right side elevational view of the second embodiment of pliers of FIG. 5.

Pin 154 not only connects holes 42, 140 and 38 but now also connects with through hole 182. Pin 152 besides connecting between holes 46, 118 and 50 now also connects with through hole 190. The result is when a squeezing force is applied to the handle assembly 16, the fourth set of jaws 170 is moved to the closing position, as shown in FIG. 5, but the third set of jaws 168 is moved to the open position. This means that the third set of jaws 168 is not intended to grip anything and actually the jaw members 172 have an exterior serrated surface 200 and jaw member has an exterior serrated surface 202. The purpose of the serrated surfaces 200 and 202 is to apply pressure in an outward direction rather than an inward direction. For example, the surfaces 200 and 202 can be forced outward against the inside surface of a tube, which is not shown. These serrated surfaces 200 and 202 could also be used to expand a snap ring, install an o-ring or usable in conjunction with any operation in which an outer force is desirable as opposed to an inwardly directed force which would normally occur within the first embodiment 10 of this invention and will occur in the fourth set of jaws 170.

Figure 7:
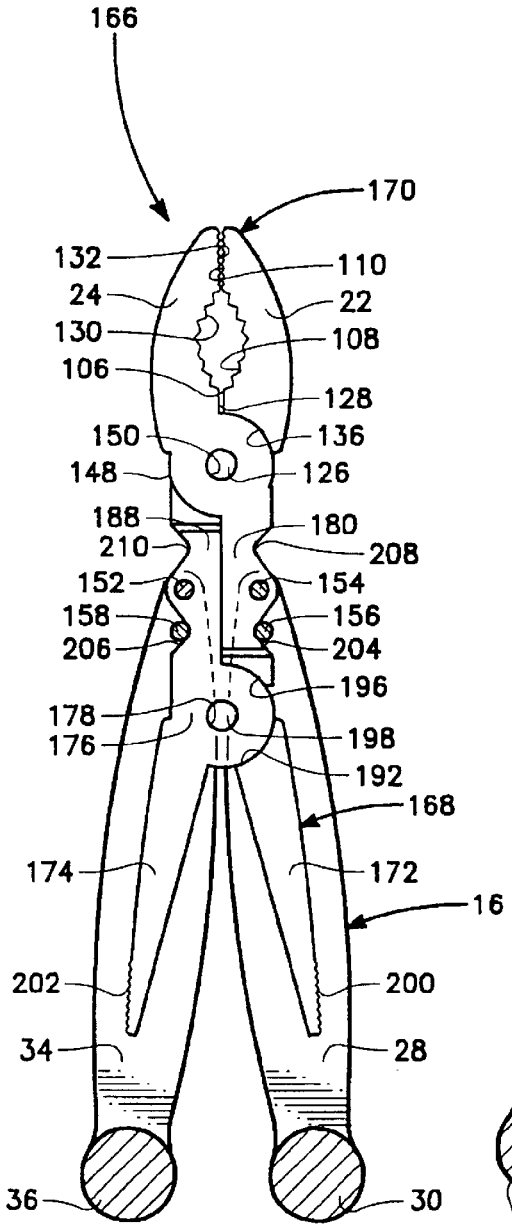
FIG. 7 is a top plan view of the second embodiment of pliers of FIG. 5 but where the blunt nose pair of jaws are placed in the normal usage position where in FIG. 5 the needle nose pair of jaws are placed in the usage position.
Figure 8:
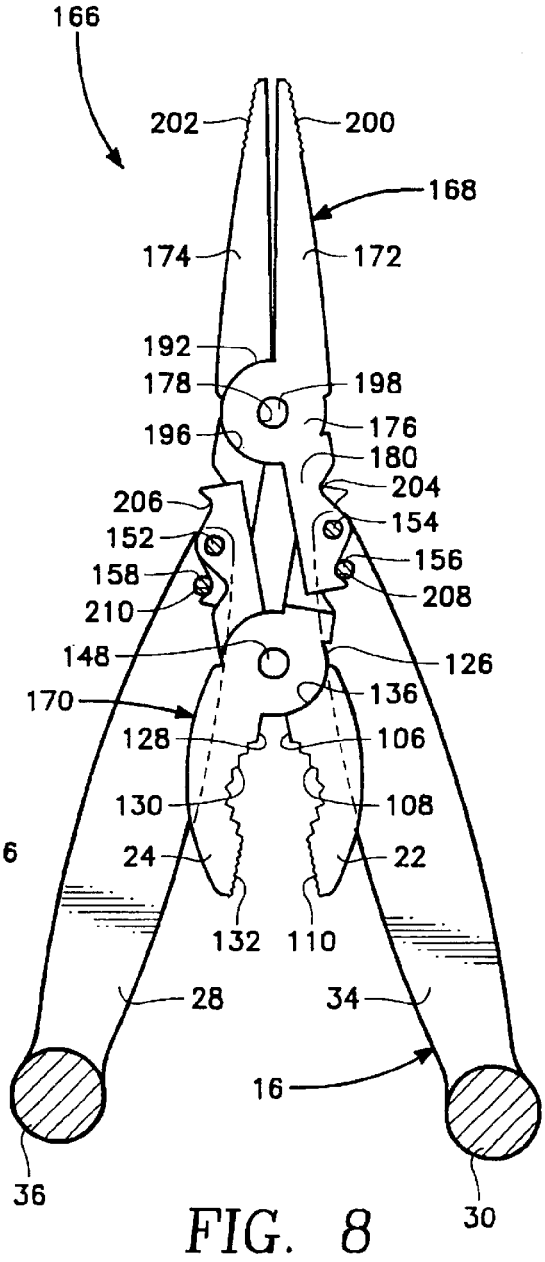
FIG. 8 is a top plan view of the second embodiment of pliers of FIG. 5 but where the handle is opened in a normal non-squeezing position which shows the needle nose pair of jaws in the closed position and the blunt nose pair of jaws in the open position where within FIG. 5 the handle assembly was shown in the squeezed position.
Figure 9:
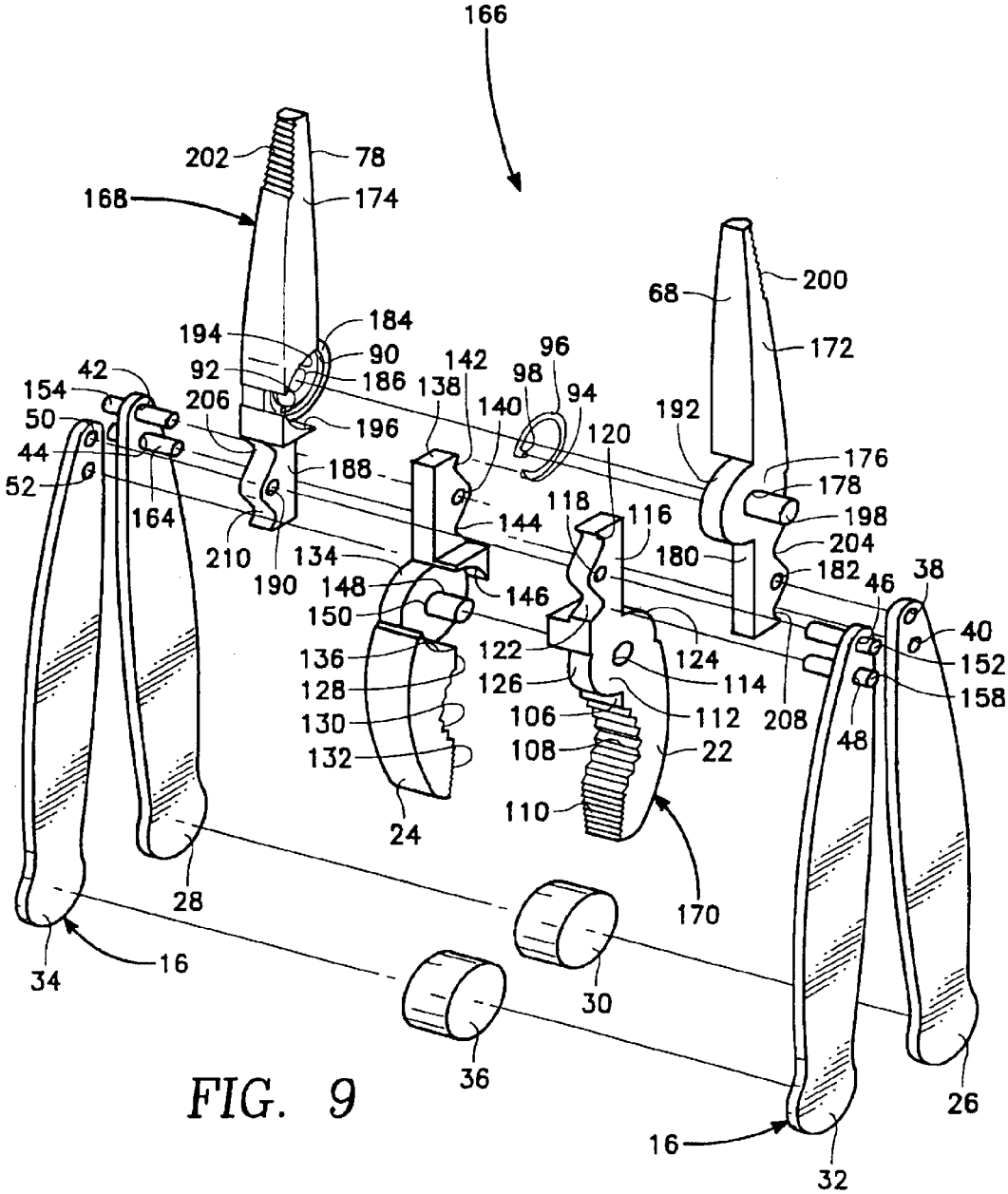
FIG. 9 is an exploded isometric view of the second embodiment of pliers of this invention.

As with the first embodiment 10, the second embodiment 166 is to be capable of having the handle assembly 16 flipped approximately one hundred and forty degrees to the position shown in FIG. 7 which will then locate connecting pin 156 with recess 204 and connecting pin 158 with recess 206. Prior to moving of the handle assembly 16 one hundred and forty degrees, the connecting pin 156 is engaged with recess 208 and connecting pin 150 is engaged with recess 210.

It is to be noted that both the first embodiment 10 and the second embodiment 166 that there is shown only a single spring 96. However, it is considered to be within the scope of this invention that there very well may be included a second spring between the center sections 112 and 134.

It is to be noted that in the first embodiment 10 of this invention that the distance X between pivot pin 152 and its directly adjacent connecting pin 158 is precisely the same as the distance between the pivot pin 154 and the connecting pin 156. This distance will normally be about five sixteenths of an inch. However, the range of distance will be anywhere between one quarter inch and one-half inch would be satisfactory. It is to be understood that the greater this distance X, the greater amount of leverage that is obtained in use of the pliers of this invention. Utilizing of the pliers of either the first embodiment 10 or the second embodiment 166 there will normally be applied at the operating head of the pliers a ten pound force when there is only a five pound squeezing force applied to the handle assembly 16.

What is claimed is:

1. A versatile use pliers having a first pair of jaws and a second pair of jaws, said second pair of jaws being reversely positioned to said first pair of jaws, said first pair of jaws having a first pivot axis about which said first pair of jaws is movable between a first closed position where first jaw members of said first pair of jaws are substantially abutting each other and a first open position where said first jaw members are angularly displaced relative to each other, said second pair of jaws having a second pivot axis about which said second pair of jaws is movable between a second closed position where second jaw members of said second pair of jaws are substantially abutting each other and a second open position where said second jaw members are angularly displaced relative to each other, when said first pair of jaws are in said first open position said second pair of jaws are in said second closed position, when said first pair of jaws are in said first closed position said second pair of jaws are in said second open position, said second jaw members being pivotally mounted to said first jaw members about a pair of spaced apart connecting axes each of which is spaced from said first pivot axis and said second pivot axis;

a handle assembly pivotally mounted to said first pair of jaws and said second pair of jaws, said handle assembly to be manually operated to cause movement between said open position and said closed position; and each first jaw member of said first jaw members having a pair of spaced apart first recesses, each second jaw member of said second jaw members having a pair of spaced apart second recesses.

2. The versatile use pliers as defined in claim 1 wherein:

said handle assembly includes abutments that press against said jaws and engage either said first recesses or said second recesses to cause said movement between said open position and said closed position, said abutments located between said first pivot axis and said second pivot axis.

3. The versatile use pliers as defined in claim 2 wherein:

said abutments including a first abutment and a second abutment, one of said connecting axes being located approximately within the range of one-fourth inch to one-half inch from said first abutment with the other of said connecting axes being located also within the range of one-fourth inch to one-half inch from said second abutment.

* * * * *